US006105664A

United States Patent [19]

Gillbrand et al.

[11] Patent Number: 6,105,664

[45] Date of Patent: Aug. 22, 2000

[54] FILTER AND HEAT EXCHANGER DEVICE

[75] Inventors: Per Gillbrand, Mariefred; Richard Öhman, Huddinge, both of Sweden

[73] Assignee: Interproperty N.V., St-Genesius-Rode, Belgium

[21] Appl. No.: 09/180,717

[22] PCT Filed: May 29, 1997

[86] PCT No.: PCT/SE97/00931

§ 371 Date: Nov. 13, 1998

§ 102(e) Date: Nov. 13, 1998

[87] PCT Pub. No.: WO97/45627

PCT Pub. Date: Dec. 4, 1997

[30] Foreign Application Priority Data

May 30, 1996 [SE] Sweden ..... 9602117

[51] Int. Cl.[7] ..... F28F 19/00

[52] U.S. Cl. ..... 165/119; 210/184; 165/916

[58] Field of Search ..... 165/41, 119, 916; 210/175, 184

[56] References Cited

U.S. PATENT DOCUMENTS

| | | | |
|---|---|---|---|
| 2,506,596 | 5/1950 | Howard | 165/80.1 |
| 3,315,737 | 4/1967 | Welch | 165/119 |
| 5,435,346 | 7/1995 | Tegidgo et al. | 137/564.5 |
| 5,948,248 | 9/1999 | Brown | 210/206 |
| 5,967,111 | 10/1999 | Hedman | 123/196 A |

FOREIGN PATENT DOCUMENTS

| | | |
|---|---|---|
| 550 281 | 4/1932 | Germany . |
| 43 22 979 | 1/1995 | Germany . |
| WO 88/06228 | 8/1988 | WIPO . |

*Primary Examiner*—Allen Flanigan
*Attorney, Agent, or Firm*—Browdy and Neimark

[57] ABSTRACT

A filter and heat exchanger device comprises a substantially cylindrical housing (11) accommodating a tubular heat exchanger body (31) having fins (35) on the outer side thereof and an axial through passageway (32, 33) communicating with secondary-liquid inlet and outlet ports (19, 20). A heat exchanger compartment (26) inside a cylindrical partition (28) in the housing (11) accommodates the heat exchanger body (31) and a filter compartment (27) outside the partition accommodates a filter body (30). The two compartments (26, 27) communicate with one another and form successive sections of a primary-liquid flow path extending between primary-liquid inlet and outlet ports (17, 18). An elongate opening in the partition (28) is substantially coextensive with the heat exchanger body (31) and defines a flow passage (29) which interconnects the heat exchanger and filter compartments (26, 27). The heat exchanger body (31) is positioned in the heat exchanger compartment (26) and defines together with the inner side of the partition (28) circumferentially extending channels between the fins (35) of the heat exchanger body (31). An axially extending channel (36) formed in the cylindrical partition (28) diametrically opposite to the flow passage (29) is substantially coextensive with and open towards the heat exchanger body (31) and communicates with the primary-liquid outlet port (18).

4 Claims, 2 Drawing Sheets

FILTER AND HEAT EXCHANGER DEVICE

This invention relates to a filter and heat exchanger device of the kind comprising: a substantially cylindrical housing having an inlet port and an outlet port for a primary liquid and an inlet port and an outlet port for a secondary liquid; a tubular heat exchanger body disposed in the housing and having fins on the outer side thereof and an axial through passageway which communicates with the inlet port and the outlet port for the secondary liquid; and a cylindrical partition in the housing, said partition defining on one side thereof a heat exchanger compartment which accommodates the heat exchanger body and defining on the other side thereof a filter compartment which accommodates a filter body, and the heat exchanger compartment and the filter compartment communicating with one another and forming successive sections of a primary-liquid flow path extending between the inlet and outlet ports for the primary liquid.

The primary liquid is a liquid which is to be filtered and cooled or heated and may be oil, for example, while the secondary liquid is a cooling or heating liquid and may be water, for example.

Filter and heat exchanger devices of this kind are often used for filtering and cooling of various working liquids, such as lubricating or transmission oil in automotive vehicles and other systems powered by internal combustion engines, hydraulic fluid in oil-hydraulic systems, or liquids in other machines or systems in which the liquid requires both filtering and cooling. An example of a filter and heat exchanger device in which a liquid is filtered and cooled in a single unit is disclosed in WO88/06228.

As is typical of known filter and heat exchanger devices of this kind, the tubular filter body of the filter and heat exchanger device disclosed in WO88/06228 is disposed inside the tubular heat exchanger body. This relative position of the filter and heat exchanger bodies is advantageous in that the heat exchanger body can be provided with as large heat transfer surfaces as the diameter of the housing of the device permits; this is desirable in most cases. On the other hand, this relative position does not allow of full utilization of the available space in the housing.

An object of the invention is to provide a filter and heat exchanger device of the kind indicated which is improved in respect of the utilization of the space. This object is achieved by the heat exchanger design defined in the independent claim. Features of preferred embodiments of the filter and heat exchanger device according to the invention are set forth in the dependent claims.

As will be described in greater detail below, the heat exchanger body of the filter and heat exchanger device according to the invention is positioned inside the filter body, and the primary liquid flows circumferentially about the heat exchanger body between axially elongate and circumferentially spaced-apart inlet and outlet passages extending through the cylindrical partition which separates the heat exchanger body from the filter body.

The arrangement according to the invention provides for an efficient heat transfer and allows a heat exchanger body of small diameter to be used without reducing the heat transfer capacity in comparison with that of known heat exchanger devices. A particularly efficient heat transfer will be achieved if the heat exchanger body is constructed in accordance with the principles explained in WO86/00395. An additional substantial advantage is that the primary-liquid pressure acting on the upstream side of the heat exchanger body—this pressure may be 10–15 bar in many applications—acts on the outer side of the heat exchanger body. This pressure is thus directed towards the centre of the heat exchanger body and consequently subjects the heat exchanger body to radial compression, rather than tending to expand the heat exchanger body. The heat exchanger body can therefore be made from a material which is of low tensile strength but is favourable in respect of the heat transfer properties, such as aluminium, without consequent danger of the heat exchanger body bursting under the pressure of the primary liquid.

The invention will be more fully understood from the following description with reference to the accompanying drawings illustrating an exemplary embodiment.

Figure 1:
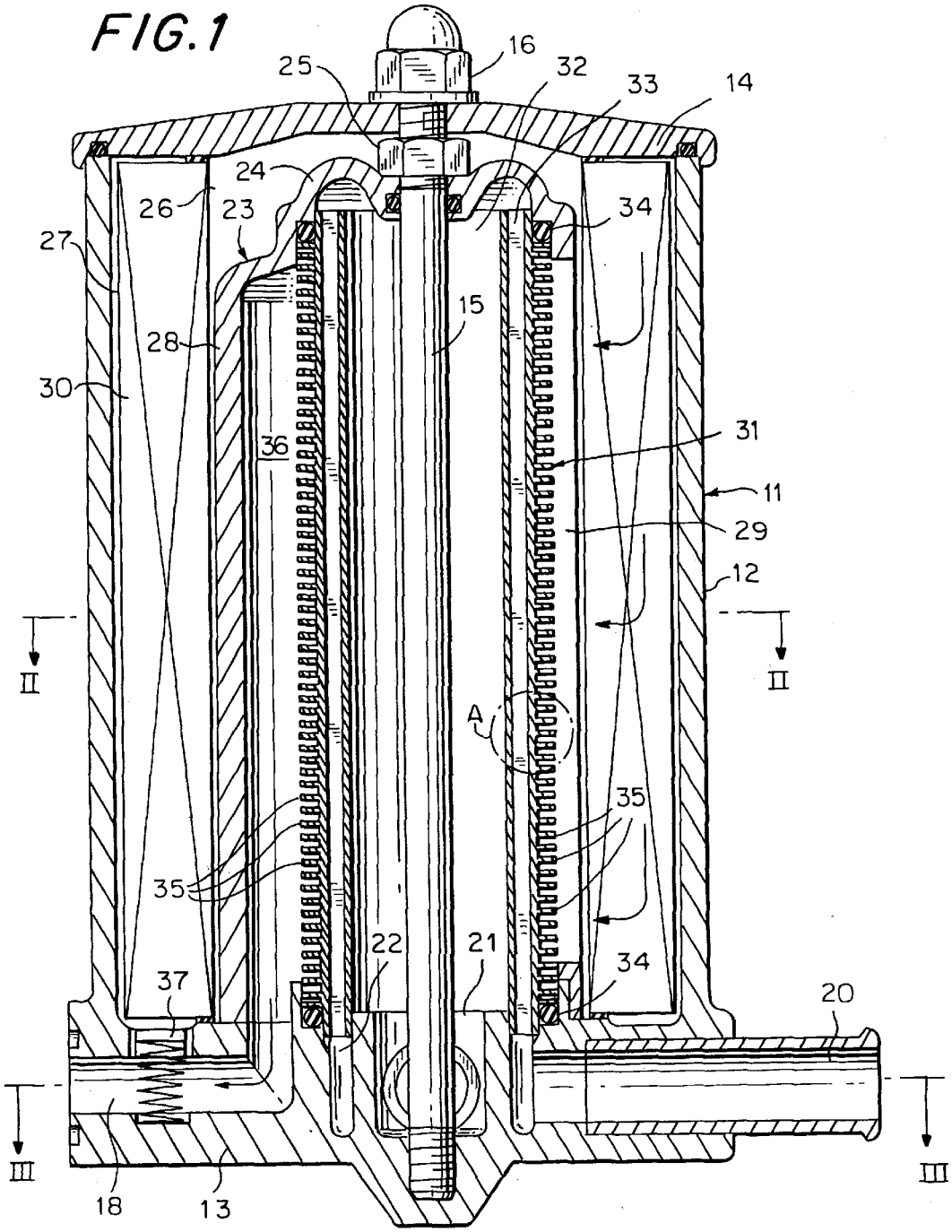
FIG. 1 is an axial sectional view of a filter and heat exchanger device embodying the invention.
Figure 1A:
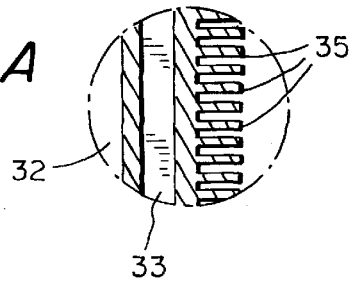
FIG. 1A is an enlarged portion of circled are A in FIG. 1.

The filter and heat exchanger device shown by way of example in the drawings comprises a generally circular cylindrical housing 11 having a circular cylindrical outer wall 12 which is integral with an end plate forming a bottom wall 13. Additionally, the housing 11 comprises a removable cover 14, which is tightly clamped to the upper end of the outer wall 12 by means of a centrally positioned screw-threaded tie rod 15 and a nut 16.

In the bottom wall 13 of the housing, inlet and outlet ports are provided both for a primary liquid to be filtered and cooled (or, alternatively, heated) and for a secondary liquid, namely a liquid serving as a heat carrier liquid for cooling (or heating) of the primary liquid. In the following description, the primary liquid is presumed to be oil while the secondary liquid is presumed to be water.

More particularly, at one side of the housing (the left side in the drawings) an oil inlet port 17 and an oil outlet port 18 are provided. These ports are positioned close to one another and open into a flat lateral face of the bottom wall 13. This flat face is adapted to be tightly clamped to a machine (not shown) in which the oil functions as a working oil to perform an operation, e.g. as a transmission or lubricating oil.

At the opposite side of the housing, the bottom wall 13 is provided with a water inlet port 19 and a water outlet port 20. The water inlet port 19 extends to a central recess 21 in the bottom wall 13 and the water outlet port 20 communicates with an annular groove 22 encircling the recess. Both the water inlet port 19 and the water outlet port 20 inlude tubular connectors for the attachment of hoses.

Inside the housing 11, there is an upstanding elongate tubular bell or cap 23 which is open at the lower end and closed by a top wall 24 at the upper end. The open lower end of the cap 23 is tightly clamped to the upper side of the housing bottom wall 13 by means of a clamping nut 25 which is provided on the tie rod 15 and engages the top wall 24 of the cap.

The cap 23 subdivides the interior space of the housing 11 into two compartments, a central compartment 26 and a surrounding outer compartment 27. On one side, the side wall 28 of the cap 23 is provided with a vertically extending narrow passage or slot 29 providing fluid communication between the two compartments 26 and 27. The central compartment 26 also communicates with the oil outlet port 18 and with both the water inlet port 19 and the water outlet port 20. A cylindrical tubular filter body 30, made of pleated paper, for example, and concentric with the housing side wall 12, is disposed in the outer compartment 27 which communicates with the oil inlet port 17 such that the inflowing oil enters the outer compartment 27 outside the filter body 30.

The central compartment 27 houses an upstanding cylindrical tubular heat exchanger body 31 the axis of which coincides with the axis of the housing side wall 12. The heat exchanger body 31, which is made of aluminium or other suitable material of high thermal conductivity, is clamped to the bottom wall 13 of the housing such that its central, through axial passageway 32 is open to the recess 21 but has no direct fluid communication with the surrounding annular groove 22. On the other hand, this groove 22 is in open fluid communication with the lower end of an outer passageway 33 which likewise extends axially through the heat exchanger body 31. The outer passageway comprises a plurality of subpassageways or channels distributed about the central passageway 32.

Both ends of the heat exchanger body 31 sealingly engage the housing bottom wall 13 and the top wall 24 of the cap through the intermediary of sealing rings 34. At the upper end of the heat exchanger body, the central passageway 32 is in open communication with the outer passageway 33.

Water entering through the water inlet port 19 will thus pass into the central recess 21 and flow upwardly through the central passageway 32 of the heat exchanger body 31 and then downwardly through the several channels forming the outer passageway 33 to the annular groove 22 before it exits through the water outlet port 20. During its travel through the housing 11, the water will thus only contact the inner part of the heat exchanger body 31.

Figure 2:
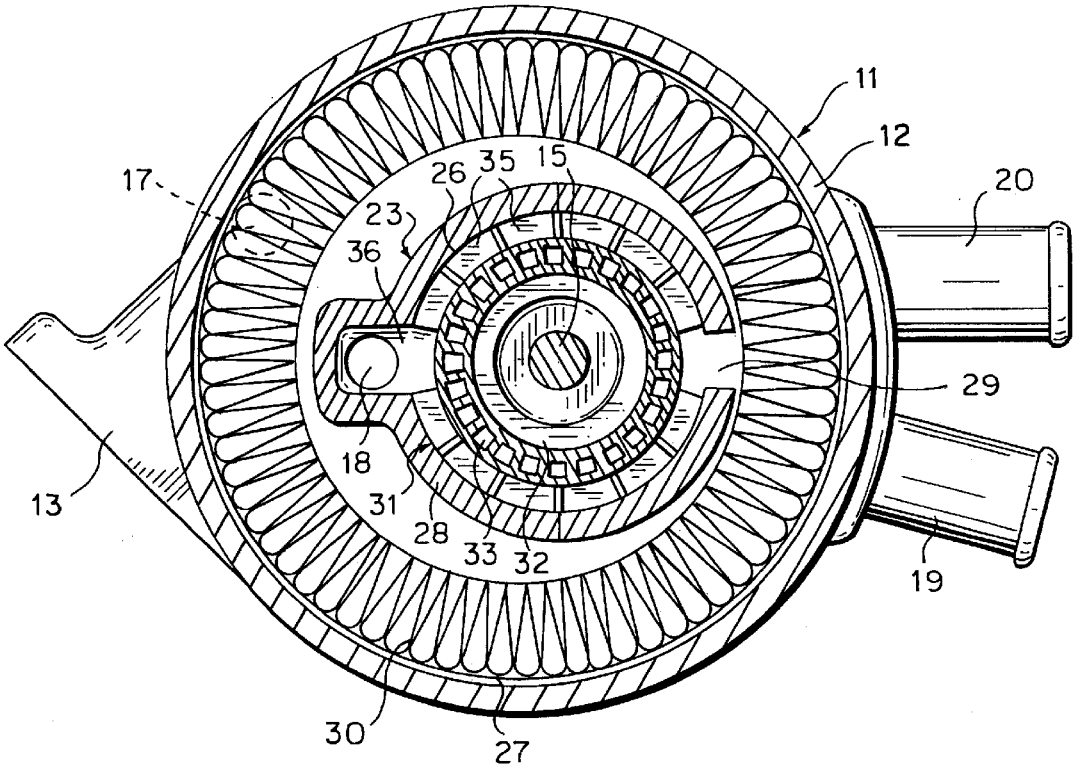
FIG. 2 is a cross-sectional view on line II—II of FIG. 1.
Figure 3:
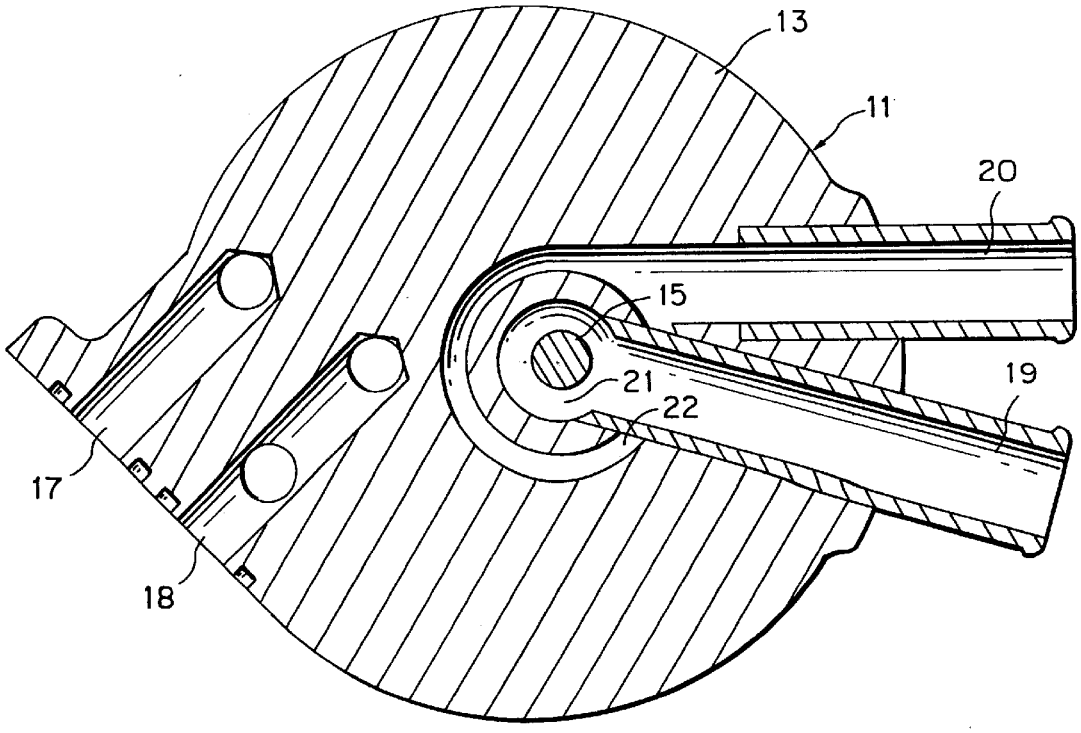
FIG. 3 is a cross-sectional view on line III—III of FIG. 1.

The circumferential outer side of the heat exchanger body 31 is provided with a very large number of closely spaced fins 35 which are arranged in planes transverse to the axis of the heat exchanger body. These fins extend substantially around the entire heat exchanger body with wider interruptions at two diametrically opposed locations and a plurality of narrower intervening interruptions (FIG. 2). The outer ends of the fins 35 are close to the inner side of the side wall 28 of the cap 23. Accordingly, to pass from the slot 29, which extends substantially throughout the height of the heat exchanger body 31, to an axially extending channel 36 which is formed in the inner side of the side wall 28 of the cap 23 diametrically opposite to the slot 29, the oil has to flow along the narrow circumferentially extending channels defined between adjacent fins 35. The fins 35 and the channels defined between them are constructed in accordance with the principles set forth in WO88/06228 and thus ensure a very efficient heat transfer between the oil flowing in the channels and the water flowing in the outer passageway 33 of the heat exchanger body 31.

By way of the channel 36, the oil flows from the central compartment 26, i.e. the heat exchanger compartment, through an opening provided in the housing bottom wall 13 opposite to the lower end of the channel 36, and to the oil outlet port 18.

Like the elongate opening or slot 29, the channel 36 extends substantially throughout the height of the heat exchanger body 31.

In operation of the filter and heat exchanger device, the oil entering through the oil inlet port 27 will first flow through the outer compartment 27, the filter compartment, and across the filter body 30 therein before it passes through the slot 29 into the inner or heat exchanger compartment 26 and flows circumferentially in both directions along the outer side of the heat exchanger body 31 before it is collected in the channel 36. If for one reason or other, such as a heavy clogging of the filter body 30, the pressure within the filter compartment 27 should rise excessively, a bypass valve 37 in the housing bottom wall 13 will open to place the filter compartment 27 in direct fluid communication with the oil outlet port 18.

What is claimed is:

1. A filter and heat exchanger device comprising a substantially cylindrical housing (11) having an inlet port (17) and an outlet port (18) for a primary liquid and an inlet port (19) and an outlet port (20) for a secondary liquid, a tubular heat exchanger body (31) disposed in the housing and having fins (35) on the outer side thereof and an axial through passageway (32, 33) which communicates with the inlet port (19) and the outlet port (20) for the secondary liquid, and a cylindrical partition (28) in the housing (11), said partition defining on one side thereof a heat exchanger compartment (26) which accommodates the heat exchanger body (31) and defining on the other side thereof a filter compartment (27) which accommodates a filter body (30), the heat exchanger compartment (26) and the filter compartment communicating with one another and forming successive sections of a primary-liquid flow path extending between the inlet port (17) and the outlet port (18) for the primary liquid, characterised in that the cylindrical partition (28) has an elongate opening substantially coextensive with the heat exchanger body (31) which opening defines a flow passage (29) through the partition and interconnects the filter compartment (27) and the heat exchanger compartment (26), the heat exchanger body (31) is positioned inside the cylindrical partition (28) and defines together with the inner side of the partition circumferentially extending flow channels between the fins (35) of the heat exchanger body (31), and the cylindrical partition (28) is provided with an axially extending flow channel (36) which is located opposite to the flow passage (29) across the heat exchanger compartment (26) and substantially coextensive with and open towards the heat exchanger body (31), said flow channel communicating with the outlet port (18) for the primary liquid.

2. A filter and heat exchanger device according to claim 1, characterised in that the axial through passageway of the heat exchanger body (31) comprises a central axial channel (32) and an outer axial channel (33) which is formed by a plurality of axial subchannels distributed around the central channel, the central channel (32) and the outer channel (33) communicating with one another at one end of the heat exchanger body (31) and communicating with respective ones of the inlet port (19) and the outlet port (20) for the secondary liquid at the other end of the heat exchanger body.

3. A filter and heat exchanger device according to claim 2, characterised in that the inlet port (19) and the outlet port (20) for the secondary liquid are provided in an end wall (13) of the housing (11) at said other end of the heat exchanger body (31).

4. A filter and heat exchanger device according to claim 1, characterised in that the inlet port (17) and the outlet port (18) for the primary liquid are provided in the housing end wall (13).

* * * * *